US009954275B2

(12) United States Patent
Zhang et al.

(10) Patent No.: US 9,954,275 B2
(45) Date of Patent: Apr. 24, 2018

(54) MULTIPLE-INPUT MULTIPLE-OUTPUT ANTENNA, SYSTEM AND MOBILE TERMINAL

(71) Applicant: ZTE Corporation, Shenzhen, Guangdong (CN)

(72) Inventors: Yu Zhang, Shenzhen (CN); Biao Li, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 22 days.

(21) Appl. No.: 14/431,612

(22) PCT Filed: Jun. 19, 2013

(86) PCT No.: PCT/CN2013/077510
§ 371 (c)(1),
(2) Date: Mar. 26, 2015

(87) PCT Pub. No.: WO2013/170798
PCT Pub. Date: Nov. 21, 2013

(65) Prior Publication Data

US 2015/0255864 A1 Sep. 10, 2015

(30) Foreign Application Priority Data

Sep. 27, 2012 (CN) ..... 2012 1 0374387

(51) Int. Cl.
*H01Q 1/52* (2006.01)
*H01Q 7/00* (2006.01)
*H01Q 21/28* (2006.01)

(52) U.S. Cl.
CPC ..... *H01Q 1/521* (2013.01); *H01Q 1/52* (2013.01); *H01Q 7/00* (2013.01); *H01Q 21/28* (2013.01)

(58) Field of Classification Search
CPC ..... H01Q 1/52; H01Q 7/00; H01Q 21/28
(Continued)

(56) References Cited

U.S. PATENT DOCUMENTS 8,085,202 B2 * 12/2011 Ayatollahi ..... H01Q 1/243 343/700 MS
8,497,806 B2 7/2013 Lai
(Continued)

FOREIGN PATENT DOCUMENTS

CN 1335654 A 2/2002
CN 101329860 A 12/2008
(Continued)

OTHER PUBLICATIONS

International Search Report in international application No. PCT/CN2013/077510, dated Sep. 26, 2013.
(Continued)

*Primary Examiner* — Huedung Mancuso
(74) *Attorney, Agent, or Firm* — Oppedahl Patent Law Firm LLC

(57) ABSTRACT

A Multiple-Input Multiple-Output (MIMO) antenna is provided, which includes a Printed Circuit Board (PCB), an antenna connected with the PCB, a feed system, and a match circuit, wherein the antenna is connected with the feed system through the match circuit, the antenna connected with the PCB is the antenna having a Loop structure, and a gap having a fixed width is provided between a ground loop of the antenna connected with the PCB and the PCB. An MIMO antenna system and a mobile terminal are also provided. By adopting the MIMO antenna, system and mobile terminal, a coupling current between the MIMO antenna and the PCB can be relatively concentrated and current amplitude is small, thereby isolation between antennas is improved.

2 Claims, 1 Drawing Sheet

(58) Field of Classification Search
USPC ..... 343/855, 860, 700 MS, 702, 846
See application file for complete search history.

(56) References Cited

U.S. PATENT DOCUMENTS

| | | | | |
|---|---|---|---|---|
| 8,552,913 | B2 * | 10/2013 | Ayatollahi | H01Q 1/243 343/702 |
| 8,599,084 | B2 * | 12/2013 | Wong | H01Q 1/243 343/749 |
| 9,059,519 | B2 * | 6/2015 | Lin | H01Q 21/28 |
| 2006/0214857 | A1 * | 9/2006 | Ollikainen | H01Q 1/243 343/702 |
| 2007/0024514 | A1 | 2/2007 | Phillips | |
| 2008/0168404 | A1 | 7/2008 | Ording | |
| 2008/0316230 | A1 | 12/2008 | Su | |
| 2010/0238072 | A1 * | 9/2010 | Ayatollahi | H01Q 1/243 343/700 MS |
| 2011/0037663 | A1 * | 2/2011 | Huang | H01Q 9/42 343/702 |
| 2011/0128206 | A1 | 6/2011 | Wakabayashi | |
| 2011/0136447 | A1 * | 6/2011 | Pascolini | H01Q 1/243 455/90.2 |
| 2012/0001815 | A1 * | 1/2012 | Wong | H01Q 1/243 343/749 |
| 2012/0019421 | A1 | 1/2012 | Lai | |
| 2012/0068905 | A1 | 3/2012 | Ayatollahi | |
| 2013/0050027 | A1 * | 2/2013 | Kim | H01Q 1/243 343/700 MS |
| 2013/0194156 | A1 | 8/2013 | Iellici | |
| 2014/0125547 | A1 * | 5/2014 | Liu | H01Q 7/005 343/866 |
| 2016/0254596 | A1 * | 9/2016 | Ai | H01Q 1/243 |

FOREIGN PATENT DOCUMENTS

| | | | |
|---|---|---|---|
| CN | 101634565 | A | 1/2010 |
| CN | 101707281 | A | 5/2010 |
| CN | 101872897 | A | 10/2010 |
| CN | 101950856 | A | 1/2011 |
| CN | 102591973 | A | 7/2012 |
| CN | 102916253 | A | 2/2013 |
| CN | 102929508 | A | 2/2013 |
| EP | 2410607 | A1 | 1/2012 |
| GB | 2484542 | A | 4/2012 |
| JP | 2006222528 | A | 8/2006 |
| JP | 2007151115 | A | 6/2007 |
| JP | 2007173929 | A | 7/2007 |
| JP | 2009253886 | A | 10/2009 |

OTHER PUBLICATIONS

English Translation of the Written Opinion of the International Search Authority in international application No. PCT/CN2013/077510, dated Sep. 26, 2013.

Supplementary European Search Report in European application No. 13790063.5, dated Jul. 22, 2015.

International Search Report in international application No. PCT/CN2013/079146, dated Oct. 24, 2013.

English Translation of the Written Opinion of the International Search Authority in international application No. PCT/CN2013/079146, dated Oct. 24, 2013

* cited by examiner

MULTIPLE-INPUT MULTIPLE-OUTPUT ANTENNA, SYSTEM AND MOBILE TERMINAL

TECHNICAL FIELD

The disclosure relates to the field of wireless communications technology, and particularly to a Multiple-Input Multiple-Output (MIMO) antenna, system and mobile terminal.

BACKGROUND

Along with rapid development of the wireless communications technology, a requirement from a mobile user on capacity and quality of wireless communications becomes higher and higher, and thus an MIMO technique, namely an MIMO wireless communications technique is proposed. In the MIMO wireless communications technique, a multi-antenna unit is adopted by an MIMO wireless communication system both at a sending end and a receiving end. Therefore, a design of the MIMO antenna becomes an important part in the MIMO wireless communications system.

In the design of the MIMO antenna, in order to obtain a good MIMO performance, not only each antenna unit is needed to have a good performance, but also a good anti-interference performance between two antenna units is needed. Generally, an electromagnetic coupling effect between two adjacent antenna units may distort current distribution on an antenna, and distortion of the current distribution may not only change radiation pattern of the antenna unit, but also change an impedance of the antenna. The nearer a distance between two antenna units is, the stronger electromagnetic coupling between the two antenna units is; the lower isolation is, the lower radiation efficiency of the antenna is.

However, currently the size of a mobile terminal device becomes smaller and smaller, it is urgent to solve a problem regarding how to provide high isolation to the MIMO antenna in the mobile terminal device which becomes smaller and smaller

SUMMARY

In view of this, the embodiments of the disclosure provide an MIMO antenna, an MIMO system, and a mobile terminal, which can make coupling current between the MIMO antenna and a Printed Circuit Board (PCB) relatively concentrated and make a current amplitude small, thus improving isolation of the antenna.

Accordingly, a technical scheme of the disclosure is implemented like this:

an MIMO antenna is provided, which may include a PCB, an antenna connected with the PCB, a feed system, and a match circuit, wherein the antenna connected with the PCB is connected with the feed system through the match circuit; the antenna connected with the PCB is an antenna having a Loop structure, and a gap having a fixed width is provided between the PCB and a ground loop of the antenna connected with the PCB.

The disclosure further provides an MIMO antenna system, which may include a PCB, a first antenna and a second antenna connected with the PCB, a first feed system, a second feed system, a first match circuit, and a second match circuit, wherein the first antenna is connected with the first feed system through the first match circuit, the second antenna is connected with the second feed system through the second match circuit; both the first antenna and the second antenna are antennas having a Loop structure, and a gap having a fixed width is provided between the PCB and a ground loop of the first antenna, and between the PCB and the ground loop of the second antenna.

Here, the antenna having the Loop structure may include the ground loop, a ground point connected with an end of the ground loop, an antenna radiator, and a signal feed point connected with an end of the antenna radiator, wherein the other end of the antenna radiator is connected with the other end of the ground loop, and the ground loop and the antenna radiator form an annular loop structure.

The disclosure further provides a mobile terminal, which may include any one of the MIMO antenna systems described above.

The MIMO antenna, MIMO antenna system, and mobile terminal provided in the disclosure have the following advantages and features:

the MIMO antenna of the disclosure adopts the antenna having a particular Loop structure, thus making a coupling current of the antenna in the PCB concentrated into a gap structure having a fixed width between the ground loop of the antenna having the Loop structure and the PCB, and reducing an amplitude of the coupling current on the PCB.

The MIMO antenna system of the disclosure adopts two MIMO antennas to share one PCB; the MIMO antenna adopts an antenna having a Loop structure and a gap structure having a fixed width is formed between the PCB and the ground loop of the antenna having the Loop structure, therefore, mutual current interference of two MIMO antennas on the PCB can be reduced, and coupling between two MIMO antennas can be reduced, and isolation can be improved without sacrificing radiation pattern of the antenna.

Additionally, the MIMO antenna of the disclosure may adopt the form of the PCB or the form of a bracket-based antenna, the cost is low and the structure is flexible. Therefore, the MIMO antenna may be widely applied in the MIMIO antenna system and further applied in various types of mobile terminals.

DETAILED DESCRIPTION

Figure 1:
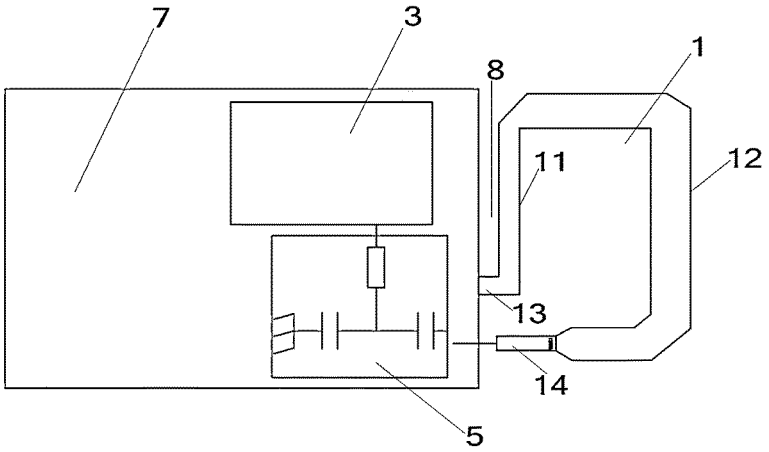
FIG. 1 is a first structure view of an MIMO antenna of the disclosure.

The disclosure provides an MIMO antenna, as shown in FIG. 1 which is a first structure view of the MIMO antenna of the disclosure. It can be seen from FIG. 1 that, the MIMO antenna includes a PCB7, a first antenna 1 connected with the PCB 7, a first feed system 3, and a first match circuit 5; wherein the first antenna 1 is connected with the first feed system 3 through the first match circuit 5. What is important is that the first antenna 1 is an antenna having a Loop structure, a gap 8 having a fixed width is provided between the PCB 7 and a ground loop 11 of the first antenna 1.

Here, the first antenna 1 includes a ground loop 11, a ground point 13 connected with an end of the ground loop 11, an antenna radiator 12, and a signal feed point 14 connected with an end of the antenna radiator 12; wherein the other end of the antenna radiator 12 is connected with the other end of the ground loop 11, and the ground loop 11 and the antenna radiator 12 form an annular loop structure.

Here, the gap 8 having the fixed width is provided between the ground loop 11 and the PCB 7, this gap may make a coupling current of the first antenna 1 in the PCB 7 relatively concentrated, and reduce an amplitude of the coupling current on the PCB 7; wherein the form of wiring of the antenna radiator 12 may be adjusted according to a specific operating frequency band and a structure feature of the PCB, and may not be limited to the structure shown in FIG. 1.

Figure 2:
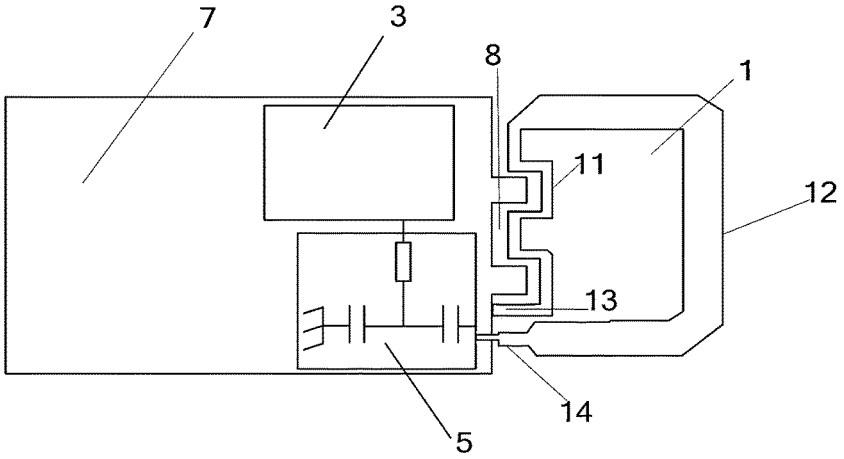
FIG. 2 is a second structure view of the MIMO antenna of the disclosure.

Additionally, the first antenna 1 may adopt the form of the PCB, or the form of a bracket-based antenna; the form of wiring of the ground loop 11 may also adopt different design schemes according to a specific circumstance, for example the length of wiring of the ground loop may be increased according to the specific circumstance, as shown in FIG. 2, the length of wiring of the ground loop may be increased by adopting a bow-shaped structure, and FIG. 2 is only used to illustrate the disclosure and is not used to limit the scope of protection of the disclosure.

Figure 3:
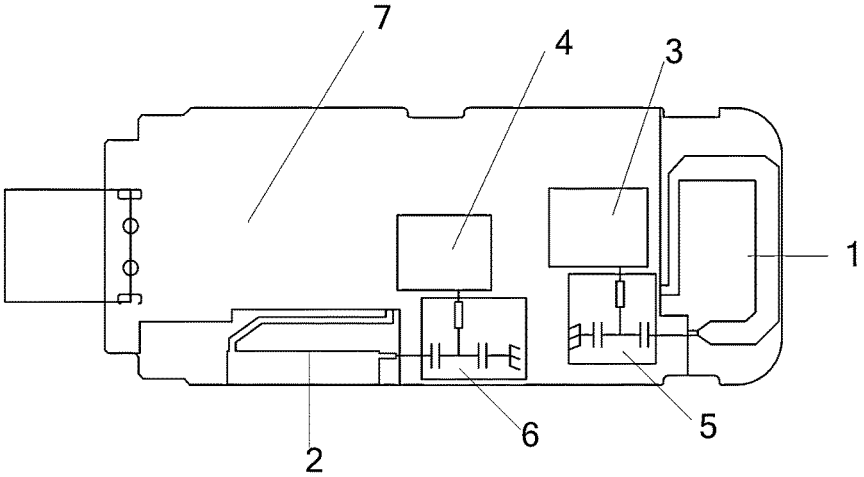
FIG. 3 is a structure view of an MIMO antenna system of the disclosure.

Based on the above MIMO antenna, the disclosure further discloses an MIMO antenna system, as shown in FIG. 3. FIG. 3 is a structure view of the MIMO antenna system of the disclosure. It can be seen from FIG. 3 that, the MIMO antenna system includes a PCB 7, a first antenna 1 and a second antenna 2 connected with the PCB 7, a first feed system 3, a second feed system 4, a first match circuit 5 and a second match circuit 6;

the first antenna 1 is located on a top of a mobile terminal, and is connected with the first feed system 3 through the first match circuit 5, a signal received by the first antenna 1 is sent to a main receiver through the first feed system 3, so that the receiving of the signal is completed; here, the first match circuit 5 is an impedance matching regulation device between the first antenna 1 and the first feed system 3; an entrance of the first feed system 3 has an impedance of 50 ohms, while the first antenna 1 usually cannot be constructed to have an ideal 50 ohms, therefore in an operating frequency band, impedance matching between the first antenna 1 and the first feed system 3 is regulated by the impedance matching regulation device, so that the impedance matching is achieved between the first antenna 1 and the first feed system 3 within the operating frequency band;

the second antenna 2 is connected with the second feed system 4 through the second match circuit 6, and the second match circuit 6 is the impedance matching regulation device between the second antenna 2 and the second feed system 4; here, an operating theory of the second antenna 2 is the same as that of the first antenna 1, and the impedance matching is achieved between the second antenna 2 and the second feed system 4 within the operating frequency band through the impedance matching regulation device;

both the first antenna 1 and the second antenna 2 are antennas having a Loop structure, and a gap having a fixed width is provided between the PCB 7 and the ground loop of the first antenna 1, and between the PCB 7 and the ground loop of the second antenna 2.

The first antenna 1 is located in a first clearance area, and the second antenna 2 is located in a second clearance area; the PCB 7 is the PCB of the whole mobile terminal, and may be a plate having a multi-layer structure.

It can be seen from FIG. 3 that, the first antenna 1 and the second antenna 2 are separately located on the top and a side of the PCB 7. However, in a specific actual application, locations of the first antenna 1 and the second antenna 2 are not limited to the circumstance shown in FIG. 3, and may be adjusted according to a specific structure and deployment of the PCB 7.

The MIMO antenna system of the disclosure adopts two MIMO antennas to share one PCB; the MIMO antenna adopts the antenna having the Loop structure and the gap structure having the fixed width is formed between the ground loop of the antenna having the Loop structure and the PCB, therefore mutual current interference of two MIMO antennas on the PCB can be reduced, and coupling between two MIMO antennas can be reduced, and the isolation can be improved without sacrificing radiation pattern of the antenna.

The disclosure further discloses a mobile terminal, and the mobile terminal includes any one of the MIMO antenna systems described above.

All those described above are only embodiments of the disclosure, and are not used to limit the scope of protection of the disclosure. It shall be pointed out that, for a person having an ordinary skill in the art, several improvements and modifications may also be made, without departing from the principle of the disclosure, and these improvements and modifications shall also be regarded as the scope of protection of the disclosure.

What is claimed is:

1. A Multiple-Input Multiple-Output (MIMO) antenna system, comprising a Printed Circuit Board (PCB), a first antenna and a second antenna connected with the PCB, a first feed system, a second feed system, a first match circuit, and a second match circuit, wherein the first antenna is connected with the first feed system through the first match circuit, the second antenna is connected with the second feed system through the second match circuit, and wherein both the first antenna and the second antenna are antennas having a Loop structure, and a gap having a fixed width is provided between the PCB and a bow-shaped ground loop of the first antenna, and between the PCB and a bow-shaped ground loop of the second antenna, wherein the antenna having the Loop structure comprises the bow-shaped ground loop, a ground point connected with an end of the bow-shaped ground loop, a single antenna radiator, and a signal feed point connected with an end of the single antenna radiator, wherein the other end of the single antenna radiator is connected with the other end of the bow-shaped ground loop, and the bow-shaped ground loop and the single antenna radiator form an annular loop structure.

2. A mobile terminal, comprising a Multiple-Input Multiple-Output (MIMO) antenna system which comprises a Printed Circuit Board (PCB), a first antenna and a second antenna connected with the PCB, a first feed system, a second feed system, a first match circuit, and a second match circuit, wherein the first antenna is connected with the first feed system through the first match circuit, the second antenna is connected with the second feed system through the second match circuit, and wherein both the first antenna and the second antenna are antennas having a Loop structure, and a gap having a fixed width is provided between the PCB and a bow-shaped ground loop of the first antenna, and between the PCB and a bow-shaped ground loop of the second antenna, wherein the antenna having the Loop structure comprises the bow-shaped ground loop, a ground point connected with an end of the bow-shaped ground loop, a single antenna radiator, and a signal feed point connected with an end of the single antenna radiator, wherein the other end of the single antenna radiator is connected with the other end of the bow-shaped ground loop, and the bow-shaped ground loop and the single antenna radiator form an annular loop structure.

* * * * *